US011305151B2

(12) United States Patent
Hsu

(10) Patent No.: US 11,305,151 B2
(45) Date of Patent: Apr. 19, 2022

(54) WATER-RESISTANCE ROWING MACHINE

(71) Applicant: Kuan-Yung Hsu, Taichung (TW)

(72) Inventor: Kuan-Yung Hsu, Taichung (TW)

( * ) Notice: Subject to any disclaimer, the term of this patent is extended or adjusted under 35 U.S.C. 154(b) by 19 days.

(21) Appl. No.: 17/106,867

(22) Filed: Nov. 30, 2020

(65) Prior Publication Data

US 2021/0170221 A1 Jun. 10, 2021

(30) Foreign Application Priority Data

Dec. 6, 2019 (TW) ..... 108216296

(51) Int. Cl.
*A63B 22/00* (2006.01)
*A63B 21/008* (2006.01)

(52) U.S. Cl.
CPC ..... *A63B 22/0076* (2013.01); *A63B 21/0084* (2013.01); *A63B 2022/0079* (2013.01)

(58) Field of Classification Search
CPC ..... A63B 21/008; A63B 21/0084; A63B 21/00845; A63B 21/0085; A63B 21/0088; A63B 21/153; A63B 21/154; A63B 22/0076; A63B 22/0087; A63B 2022/0079; A63B 2022/0082; A63B 2022/0084
See application file for complete search history.

(56) References Cited

U.S. PATENT DOCUMENTS 4,688,791 A * 8/1987 Long ..... A63B 22/0605 482/112
2012/0277071 A1* 11/2012 Lin ..... A63B 23/1209 482/111
2016/0059945 A1* 3/2016 Arad ..... B63B 1/121 440/23
2017/0209729 A1* 7/2017 King ..... A63B 23/1263
2019/0118021 A1* 4/2019 Liu ..... A63B 21/0084

* cited by examiner

*Primary Examiner* — Loan B Jimenez
*Assistant Examiner* — Peter H Forstner
(74) *Attorney, Agent, or Firm* — Rosenberg, Klein & Lee

(57) ABSTRACT

A water-resistance rowing machine has a frame body, a water-resistance unit, at least one blade wheel, a pulling strap, and a seat. The frame body has an elongated beam and a pulley rotatably mounted on the frame body. The water-resistance unit has a water tank extending along the elongated beam, a rotating shaft disposed in the water tank and extending along and being parallel to the elongated beam, and a strap wheel assembly connected with the rotating shaft to drive the rotating shaft to spin. The at least one blade wheel is mounted on and rotated with the rotating shaft. The pulling strap is wrapped around the pulley and has an end connected with the strap wheel assembly and a handle formed on another end of the pulling strap. The seat is mounted on the elongated beam.

12 Claims, 6 Drawing Sheets

WATER-RESISTANCE ROWING MACHINE

BACKGROUND OF THE INVENTION

1. Field of the Invention

The present invention relates to fitness equipment, and more particularly to a water-resistance rowing machine that can provide increased resistance without further increasing a space occupied by the water-resistance rowing machine.

2. Description of Related Art

A rowing machine is the fitness equipment to simulate an action of boat rowing for muscle training. With reference to FIGS. 5 and 6, a conventional water-resistance rowing machine has a frame body 80, a water tank 90, a vertical rotating shaft 91 vertically and rotatably mounted in the water tank 90, a blade wheel 70 fixed on and surrounding the rotating shaft 91, and a pulling strap connected to the rotating shaft 91. A user can pull the pulling strap to drive the blade wheel 70 under the water to spin. To spin the blade wheel 70, the user needs to apply a force larger than a resistance of water to the blade wheel 70. Therefore, the user is training by pulling the pulling strap repeatedly.

The frame body 80 of the conventional water-resistance rowing machine has a transversally extending beam 81. The rotating shaft 91 is vertically mounted in the water tank 90. A height of the water tank 90 is limited such that a total height of the conventional water-resistance rowing machine is limited. To increase the resistance of the conventional water-resistance rowing machine without increasing the total height thereof, an amount of blades of the blade wheel 70 is increased instead of increasing the amount of the blade wheels 70 fixed on the vertical rotating shaft 91. However, to increase the amount of the blades of the blade wheel 70, a girth of a hub of the blade wheel 70 is increased accordingly. Therefore, a diameter of the water tank 90 is increased. The diameter of the water tank 90 may be larger than a width W of the frame body 80 of the conventional water-resistance rowing machine, such that a total width of the conventional water-resistance rowing machine is increased. Accordingly, the conventional water-resistance rowing machine having larger resistance occupies quite a large space.

To overcome the shortcomings, the present invention provides a water-resistance rowing machine to mitigate or obviate the aforementioned problems.

SUMMARY OF THE INVENTION

The main objective of the present invention is to provide a water-resistance rowing machine that can provide increased resistance without further increasing the space occupied by the water-resistance rowing machine.

The water-resistance rowing machine has a frame body, a water-resistance unit, at least one blade wheel, a pulling strap, and a seat. The frame body has an elongated beam and a pulley rotatably connected with the frame body. The water-resistance unit has a water tank being elongated and extending along the elongated beam, a rotating shaft mounted in the water tank and extending along and being parallel to the elongated beam, and a strap wheel assembly connected with the rotating shaft to drive the rotating shaft to spin. Each of the at least one blade wheel has a hub fixed on and surrounding the rotating shaft to rotate with the rotating shaft and multiple blades arranged around the hub.

The pulling strap is wrapped around the pulley and has two ends. One of the two ends of the pulling strap is connected with the strap wheel assembly and the other one of the two ends of the pulling strap has a handle. The seat is mounted on a top of the elongated beam.

Other objects, advantages, and novel features of the invention will become more apparent from the following detailed description when taken in conjunction with the accompanying drawings.

DETAILED DESCRIPTION OF PREFERRED EMBODIMENTS

Figure 1:
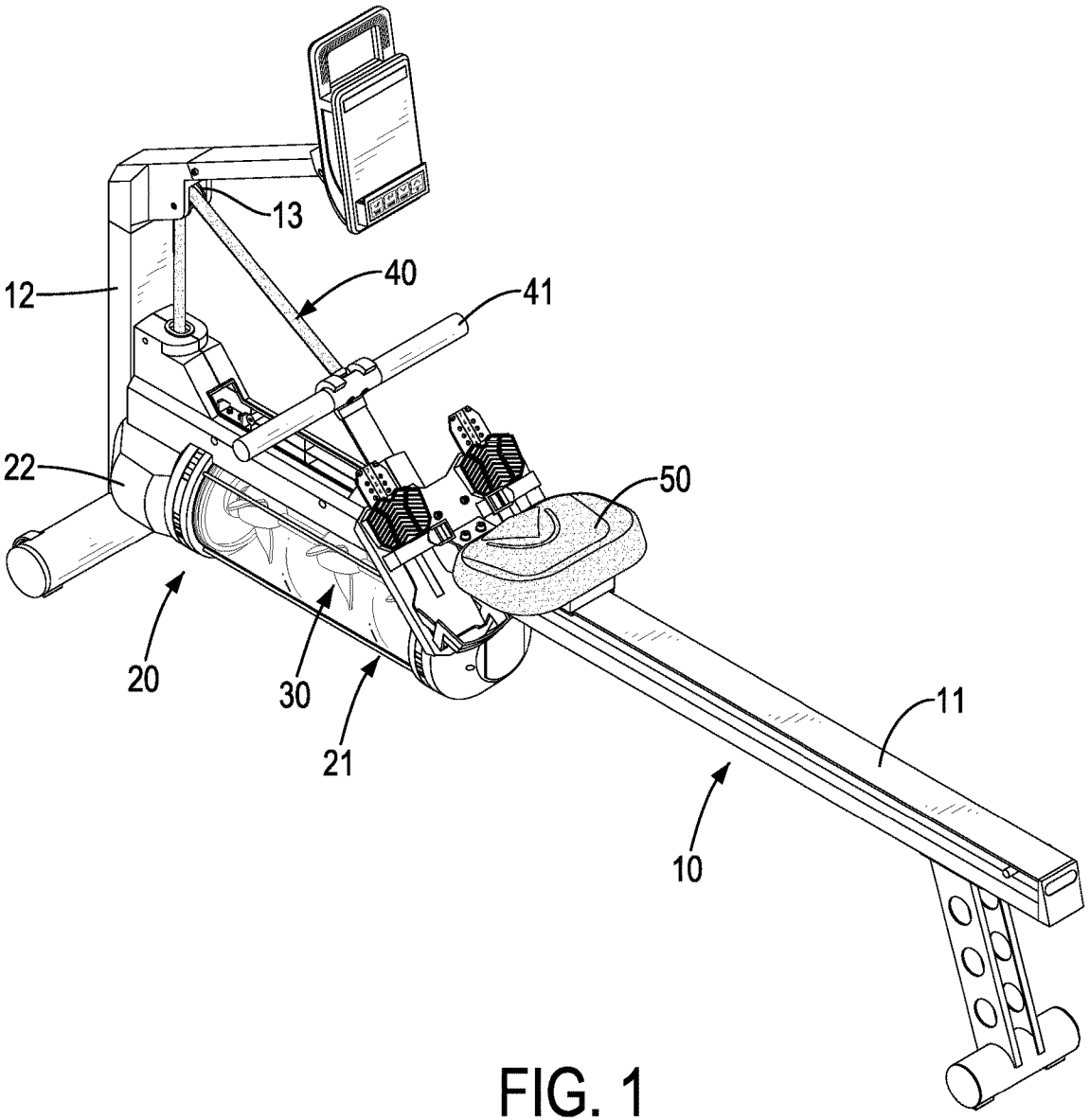
FIG. 1 is a perspective view of a water-resistance rowing machine in accordance with the present invention.
Figure 2:
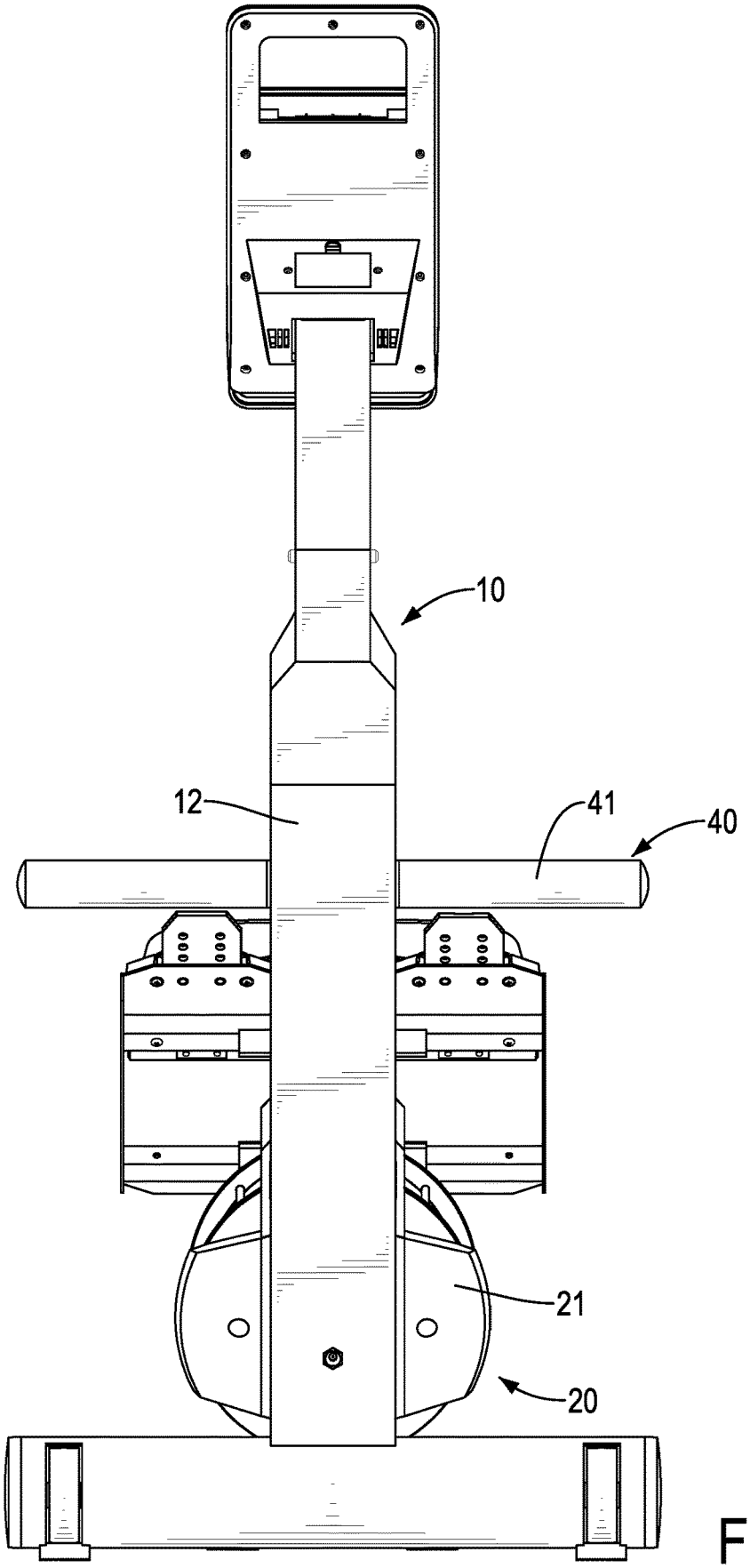
FIG. 2 is a top side view of the water-resistance rowing machine in FIG. 1.

With reference to FIGS. 1 to 3, and 3A, a water-resistance rowing machine in accordance with the present invention comprises a frame body 10, a water-resistance unit 20, at least one blade wheel 30, a pulling strap 40, and a seat 50. The water-resistance unit 20, the pulling strap 40, and the seat 50 are mounted on the frame body 10. The at least one blade wheel 30 is disposed in the water-resistance unit 20.

The frame body 10 has an elongated beam 11, a support 12, and a pulley 13. The elongated beam 11 extends transversally, and has a first end and a second end opposite to each other. The support 12 is located near the first end of the elongated beam 11 and extends vertically. The pulley 13 is rotatably connected with the support 12 of the frame body 10 and is located above the elongated beam 11.

Figure 3A:
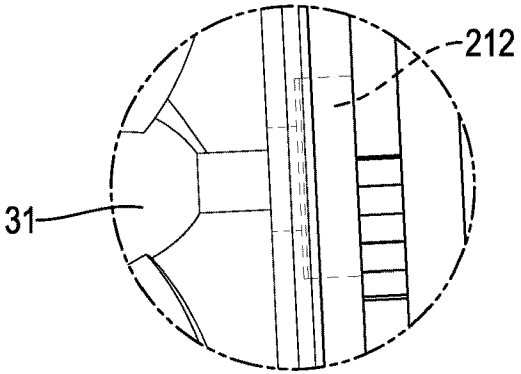
FIG. 3A is an enlarged side view of the water-resistance rowing machine in FIG. 3.
Figure 3:
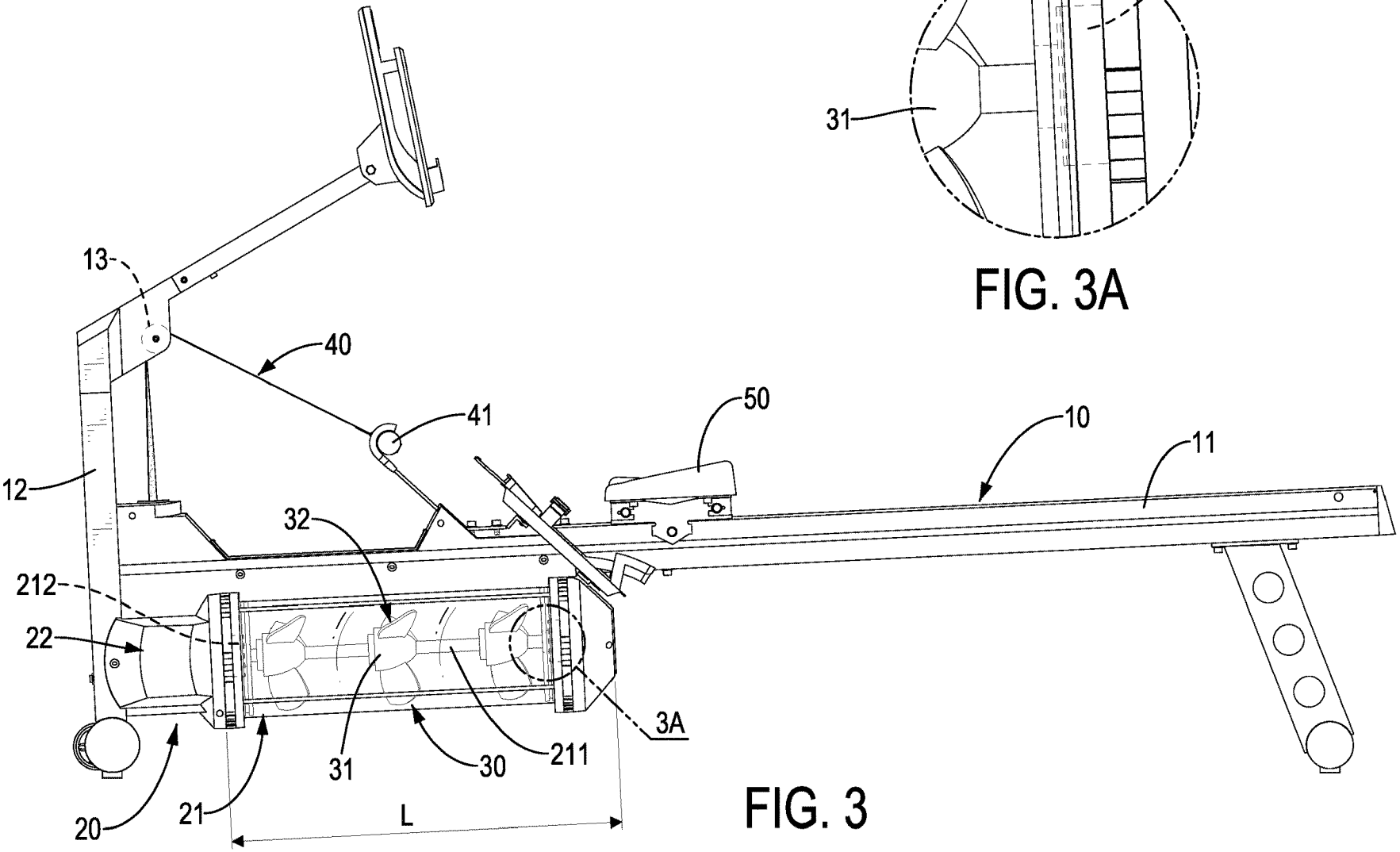
FIG. 3 is a side view of the water-resistance rowing machine in FIG. 1.
Figure 4A:
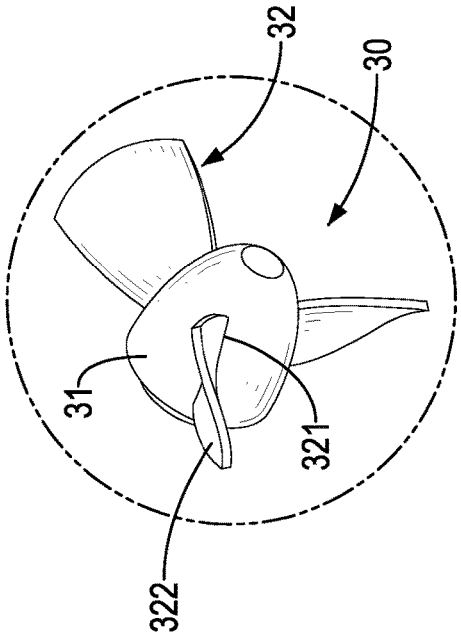
FIG. 4A is an enlarged perspective view of the water-resistance rowing machine in FIG. 4.
Figure 4:
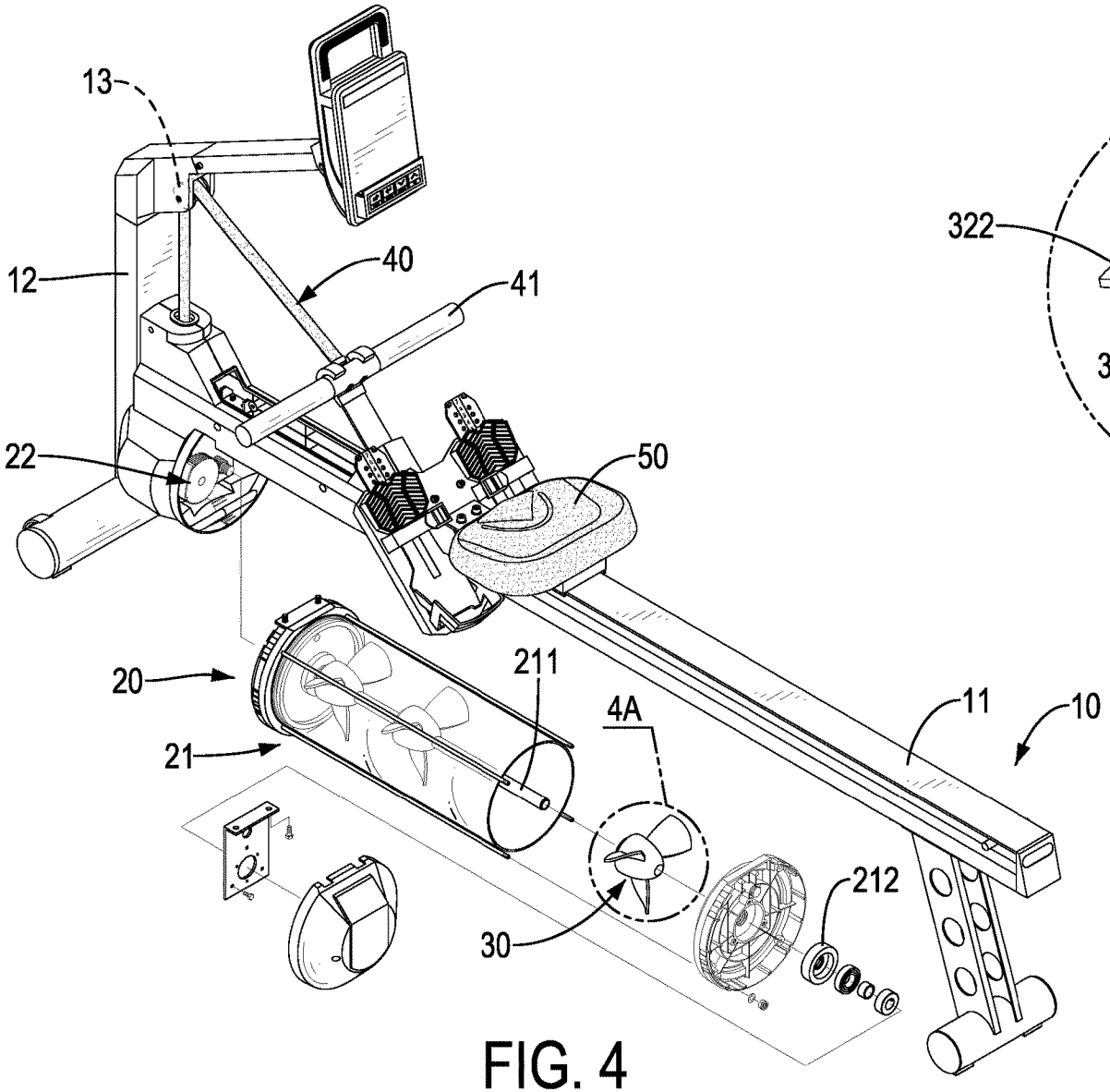
FIG. 4 is an exploded perspective view of the water-resistance rowing machine in FIG. 1.
Figure 5:
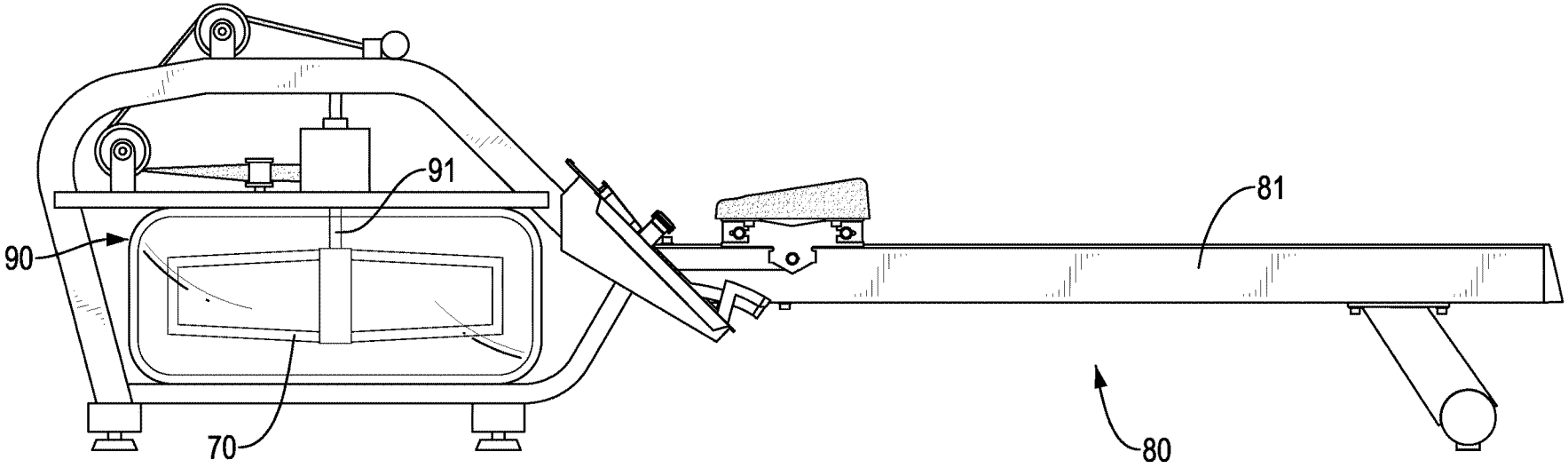
FIG. 5 PRIOR ART
FIG. 5 is a side view of a water-resistance rowing machine in accordance with the prior art.
Figure 6:
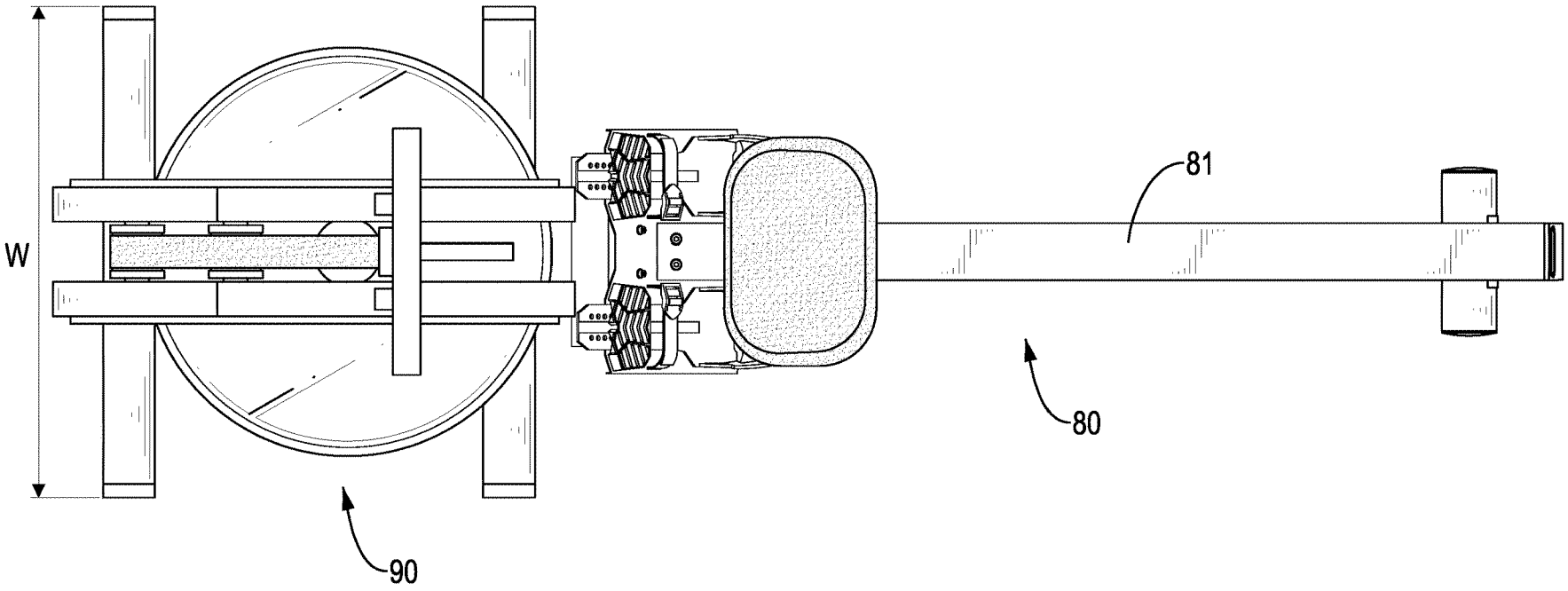
FIG. 6 PRIOR ART
FIG. 6 is a top side view of the water-resistance rowing machine in FIG. 5.

With reference to FIGS. 3 and 4, the water-resistance unit 20 is mounted on the elongated beam 11 and is located below the elongated beam 11. The water-resistance unit 20 has a water tank 21, a rotating shaft 211, and a strap wheel assembly 22. The water tank 21 is elongated and extends along the elongated beam 11. The rotating shaft 211 is disposed in the water tank 21, extends along the elongated beam 11, and is parallel to the elongated beam 11. The water tank 21 has two bearings 212 surrounding and supporting the rotating shaft 211 and arranged near two opposite ends of the rotating shaft 211, respectively. The strap wheel assembly 22 is arranged near the support 12 and is connected to one of the two ends of the rotating shaft 211 to drive the rotating shaft 211 to spin. The water tank 21 is kept from protruding from the first end and the second end of the elongated beam 11.

With reference to FIGS. 3, 4, and 4A, in the embodiment, an amount of the at least one blade wheel 30 is three. The three blade wheels 30 are placed in the water tank 21 and fixed on and arranged along the rotating shaft 211 at spaced intervals. Each blade wheel 30 has a hub 31 and multiple blades 32. The hub 31 is fixed on and surrounds the rotating shaft 211 to rotate with the rotating shaft 211. The hub 31 has two opposite ends corresponding to the two ends of the rotating shaft 211, respectively. The blades 32 of the blade wheel 30 are arranged around the hub 31. Each of the blades 32 has a blade root 321 near the hub 31 and a blade tip 322 away from the hub 31. The blade root 321 of each of the blades 32 curvedly extends from a position near one of the two opposite ends of the hub 31 toward the other one of the two opposite ends of the hub 31.

With reference to FIGS. 1 and 3, the pulling strap 40 is wrapped around the pulley 13 of the frame body 10 and has an end connected with the strap wheel assembly 22. The pulling strap 40 can be pulled out from the strap wheel assembly 22 and be wrapped into the strap wheel assembly 22 by a restoring force of the strap wheel assembly 22 to drive the strap wheel assembly 22 to rotate the rotating shaft 211. An end of the pulling strap 40 away from the strap wheel assembly 22 has a handle 41. The seat 50 is mounted on a top of the elongated beam 11.

With reference to FIGS. 3 and 4, the rotating shaft 211 in the water tank 21 of the water-resistance unit 20 extends along and is parallel to the elongated beam 11. Therefore, an amount of the blade wheels 30 arranged along the rotating shaft 211 can be increased to increase the resistance of the water-resistance rowing machine. In addition, as long as a length L of the water tank 21 is smaller than a length of the elongated beam 11 and the water tank 21 is kept from extending out the first end and the second end of the elongated beam 11, a space occupied by the water-resistance rowing machine will not be increased. Accordingly, the amount of the blade wheels 30 arranged along the rotating shaft 211 can be increased to increase the resistance of the water-resistance rowing machine without further increasing the space occupied by the water-resistance rowing machine.

With reference to FIGS. 3 and 4, because the blade root 321 of each of the blades 32 of each of the blade wheels 30 curvedly extends from a position near one of the two opposite ends of the hub 31 toward the other one of the two opposite ends of the hub 31, while the blade wheels 30 are spinning, water in the water tank 21 will be guided to flow from one end to the other end of the water tank 21 by the blade wheels 30. After the water in the water tank 21 hits an end surface of the water tank 21, the water will flow back to apply additional resistance to the blade wheels 30 to further increase the water resistance of the blade wheels 30.

With reference to FIGS. 3 and 4, the three blade wheels 30 are rotated with the rotating shaft 211, and the blades 32 of each blade wheel 30 are arranged around the rotating shaft 211. Therefore, the water resistance will be generated even if only one of the blades 32 of each blade wheel 30 is under the water filled in the water tank 21. Accordingly, the water filled in the water tank 21 can be decreased.

What is claimed is:

1. A water-resistance rowing machine comprising:
- a frame body having
  - an elongated beam; and
  - a pulley rotatably connected with the frame body;
- a water-resistance unit having
  - a water tank being elongated and extending along the elongated beam;
  - a rotating shaft disposed in the water tank and extending along and being parallel to the elongated beam; and
  - a strap wheel assembly connected with the rotating shaft to drive the rotating shaft to spin;
- at least one blade wheel, each of the at least one blade wheel having
  - a hub fixed on and surrounding the rotating shaft to rotate with the rotating shaft; and
  - multiple blades arranged around the hub;
- a pulling strap wrapped around the pulley and having two ends, one of the two ends of the pulling strap connected with the strap wheel assembly and the other one of the two ends of the pulling strap having a handle; and
- a seat mounted on a top of the elongated beam.

2. The water-resistance rowing machine as claimed in claim 1, wherein
- the hub of each of the at least one blade wheel has two opposite ends; and
- each of the blades of each of the at least one blade wheel has
  - a blade root located near the hub of the at least one blade wheel and curvedly extending from one of the two opposite ends to the other one of the two opposite ends of the hub; and
  - a blade tip located away from the hub of the at least one blade wheel.

3. The water-resistance rowing machine as claimed in claim 2, wherein the water tank has two bearings surrounding the rotating shaft and arranged near the two opposite ends of the rotating shaft, respectively.

4. The water-resistance rowing machine as claimed in claim 3, wherein the water-resistance unit is mounted on the elongated beam.

5. The water-resistance rowing machine as claimed in claim 4, wherein the water-resistance unit is disposed at a position below the elongated beam.

6. The water-resistance rowing machine as claimed in claim 3, wherein the water-resistance unit is disposed at a position below the elongated beam.

7. The water-resistance rowing machine as claimed in claim 2, wherein the water-resistance unit is mounted on the elongated beam.

8. The water-resistance rowing machine as claimed in claim 7, wherein the water-resistance unit is disposed at a position below the elongated beam.

9. The water-resistance rowing machine as claimed in claim 2, wherein the water-resistance unit is disposed at a position below the elongated beam.

10. The water-resistance rowing machine as claimed in claim 1, wherein the water-resistance unit is mounted on the elongated beam.

11. The water-resistance rowing machine as claimed in claim 10, wherein the water-resistance unit is disposed at a position below the elongated beam.

12. The water-resistance rowing machine as claimed in claim 1, wherein the water-resistance unit is disposed at a position below the elongated beam.

* * * * *